United States Patent [19]

Mackie

[11] 4,165,047

[45] Aug. 21, 1979

[54] YARN WINDER

[75] Inventor: Gordon Mackie, Belfast, Northern Ireland

[73] Assignee: James Mackie & Sons Limited, Belfast, Northern Ireland

[21] Appl. No.: 881,426

[22] Filed: Feb. 27, 1978

[30] Foreign Application Priority Data

Mar. 4, 1977 [GB] United Kingdom ..... 9254/77

[51] Int. Cl.[2] ..... B65H 54/28

[52] U.S. Cl. ..... 242/43 A

[58] Field of Search ..... 242/43 A, 158 B

[56] References Cited

U.S. PATENT DOCUMENTS

| | | | |
|---|---|---|---|
| 1,475,525 | 11/1923 | Tober | 242/43 A |
| 2,238,128 | 4/1941 | Nydegger | 242/43 A |
| 3,374,961 | 3/1968 | Otsuka et al. | 242/43 A |
| 3,650,486 | 3/1972 | Hasegawa et al. | 242/43 A |

FOREIGN PATENT DOCUMENTS

| | | | |
|---|---|---|---|
| 972440 | 8/1950 | France | 242/158 B |
| 37025 | 10/1971 | Japan | 242/43 A |
| 1100254 | 1/1968 | United Kingdom | 242/158 B |

*Primary Examiner*—Stanley N. Gilreath

*Attorney, Agent, or Firm*—Larson, Taylor and Hinds

[57] ABSTRACT

A yarn winder includes a package support roller and traversing mechanism which comprises slot-like guides on closely spaced contra-rotating driving members which may be either concentric or eccentric. A deflector arrangement at each end of the resultant field of traverse assists the transfer of the yarn from a guide on one driving member at one end of the field and then back to a guide on the first driving member at the other end of the field, each guide being followed in the direction of motion by a cam-like compensating surface, for temporarily increasing the length of the yarn path to take up slack which would otherwise be formed during transfer from one guide to another, and, in the case of concentric driving members, preceded in the direction of motion by a ramp-like lifting surface. Each of the deflector arrangements includes a control surface which is engaged by the yarn between the two yarn guides and is located in a gap defined on each side by a driving member and its associated yarn guide, the control surface at one end of the field of traverse being arranged to deflect the yarn in a direction away from the guides when the yarn is being transferred from an outer to an inner guide, and that at the opposite end of the field acting to depress the yarn toward the guides when the yarn is being transferred from an inner to an outer guide. Further control surfaces may be included for assisting the release of the yarn by a guide on one driving member and its retention by a guide on the other driving member to which it is being transferred.

15 Claims, 13 Drawing Figures

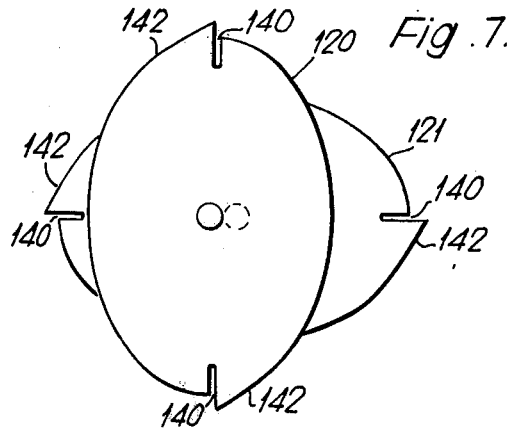
Fig. 7.
Fig. 5.
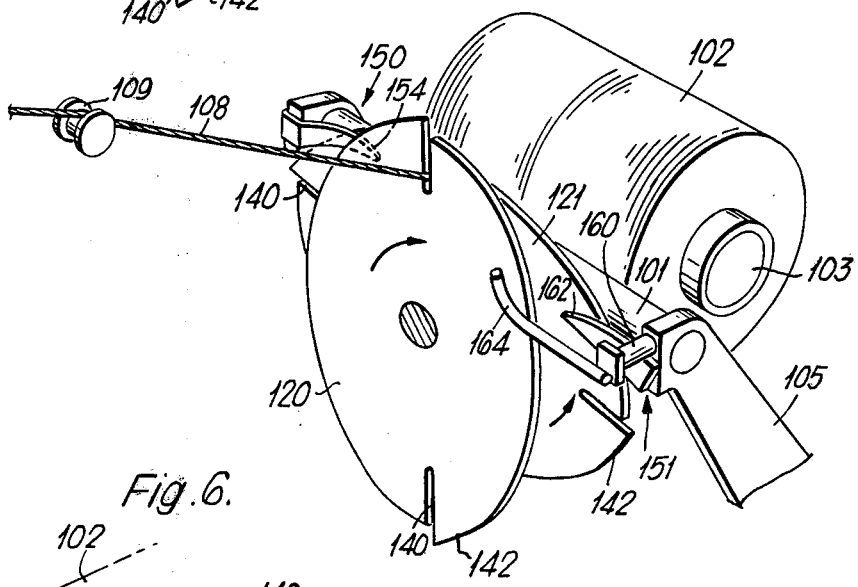
Fig. 6.
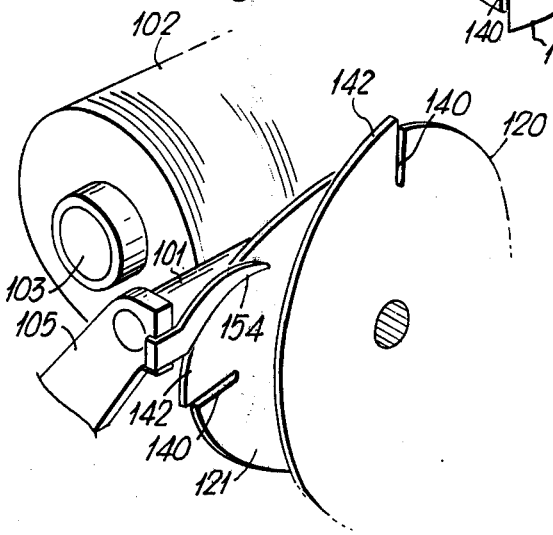

YARN WINDER

This invention relates to the winding of textile strands such as yarns, filaments or tapes of natural, man-made or synthetic materials (all referred to subsequently as "yarns") and is particularly concerned with the traversing mechanism necessary for laying the yarn on the package in a regular fashion. The traditional mechanism for producing such traversing motion includes a grooved scroll which either engages the yarn directly or drives a yarn guide so as to cause it to carrty out a reciprocatory traversing motion. Such mechanisms are, however, limited as to their speed of operation and naturally there is a demand in all fields for higher speeds and hence higher production rates.

Recently developed methods of yarn production such as continuous filament extrusion and texturising have further emphasized this demand for winders having very much higher speeds of operation and one form of traversing mechanism which has been proposed for operation at such high speeds includes slot-like yarn guides mounted on closely spaced driving members moving in opposite directions across the traverse so that the yarn in carried from one end of the traverse to the other by a guide of one member and is then transferred to a guide of the other member so as to be carried back in opposite direction. This avoids the problem arising from the inertia of the yarn guides or other parts being caused to move first in one direction and then the other with a very abrupt reversal at the end of each traverse. The transfer of the yarn from one guide to another presents its own problems and proposals have been made to include a deflector arrangement at each end of the field of traverse for assisting the transfer of the yarn from one guide to the other. Such traversing mechanisms need to be used in conjunction with a package support roller on the winder so that the yarn passes from the yarn guide to a nip between the package and the support roller and is thus maintained under control over this part of its travel.

The driving members may take various forms such as belts or chains which drive the yarn guides in a straight line across the traverse, or rotary discs or blades which may or may not be co-axial, which drive the yarn guides across the traverse along an arc of a circle. Whatever the form of driving members, each yarn guide moves in a continuous path with no abrupt changes in velocity or direction so that it is only the inertia of the yarn itself which comes into question at each reversal point. This applies irrespective of whether the winding package is surface driven by contact with a driving roller or is wound directly upon a driven winding spindle and simply rests against a small diameter control roller, i.e. whether the support roller referred to above takes the form of a driving roller or merely a driven control roller.

In order to maintain a close control of the yarn as it is transferred from a yarn guide on one driving member to a yarn guide on the other driving member, it has been the tendency for the spacing between two driving members to be as small as reasonably possible, but we have found that such close spacing tends to have a nipping action on the yarn, similar to that of scissors, as the yarn passes in contact with the two closely adjacent surfaces moving in opposite directions at high speeds. This tends to pluck the yarn and thus effect its quality. We have also found that the previously proposed deflector arrangements at the opposite ends of the field of traverse have been inadequate to exert full control over the yarn during transfer from one driving member to the other.

According to the present invention, each of the deflector arrangements in a yarn winder including a traversing mechanism of the kind described and a package support roller, includes a control surface which is engaged by the yarn between the yarn guides and is located in a gap defined on each side by a driving member and its associated yarn guide. The additional control thus applied to the yarn while passing between the two yarn guides at which the transfer is taking place makes it possible to increase the gap between the driving members to a value at which any risk of nipping action is avoided and facilitates the transfer to an extent sufficient to improve the winding action as a whole.

It is found in practice that the yarn transfer conditions may vary with the type of yarn being wound and are slightly different at the two ends of the field of traverse. At the end where the yarn is being transferred from an outer to an inner guide, the control surface between the guides is preferably arranged to deflect the yarn in a direction away from the guides while at the opposite end of the field, the control surface acts to depress the yarn towards the guides. In this connection, the terms "inner" and "outer", whether applied to the yarn guides or the driving members or to indicate one side of the other of a driving member, are used in this specification to indicate that the part in question is respectively either closer to or further from the package. The path of the yarn through the guides and to the package may be approximately horizontal, approximately vertical or at some angle between the two and the relative dispositions of the driving members and the yarn guides will differ accordingly. The use of the terms "inner" and "outer" is therefore used in order to avoid the need to differentiate between differing horizontal or differing vertical dispositions of the parts in question.

One of the minor defects to which a traversing mechanism of the kind with which the present invention is concerned is susceptible may arise from a momentary loss in tension at each transfer point which manifests itself in the form of "cobwebbing" on the package being wound. The reason for this possible loss in tension is because when the end of each traverse is reached, the path of the yarn is in the form of a wide-angled V having its apex at the yarn guide with a short limb extending between the yarn guide and the package being wound and a longer limb extending back along the feed path of the yarn. Accordingly, the tension in the yarn has a resultant acting inwardly along the general line of traverse, this resultant being overcome, up to the point of transfer, by the force exerted by the yarn guide. During the transfer of the yarn from one yarn guide to the other and shortly thereafter, the resultant force tends to move the yarn along the line of traverse. This movement is only slight, i.e. equivalent to the width of a yarn guide, but nevertheless represents a noticeable factor in the overall operation.

In order to overcome this disadvantage, the momentary loss of tension may be largely compensated for by temporarily increasing the length of the yarn path so as to counteract the effect of the straightening just described. This temporary increase is preferably provided by the provision of a cam-like compensating surface which follows each yarn guide in the direction of motion. Consequently, immediately after the yarn has been removed from one yarn guide, the yarn path is caused to bulge outwardly in a direction perpendicular to the direction of traverse for a short period of time corresponding at least approximately to that over which tension would otherwise to be lost.

As mentioned previously, the driving members can take a variety of forms, but in general, rotary members are the most convenient and these may be either concentric or eccentric. The use of eccentric members has the advantage that a yarn guide from which the yarn is being transferred tends to move away from the general line of the path of traverse and thus facilitates the removal of the yarn from that guide. If concentric members are used, there is no equivalent divergence and the removal of the yarn from the guide from which it is being transferred is therefore preferably facilitated by so shaping the periphery of at least the inner driving member that each yarn guide is preceded in the direction of motion by a ramp-like lifting surface. "Lifting" is used in this context to indicate removal of the yarn from the yarn guide and not necessarily movement in a vertical direction since this movement will be horizontal if the members are turning in a generally horizontal plane. As previously explained, the transfer conditions are different at the two ends of the field of traverse and although the ramp-like lifting surfaces are preferably provided on both members, they are most important on the inner member in order to facilitate removal of the yarn from the guides on the outer member when the transfer is from a guide on the outer member to one on the inner member.

When using a co-axial construction, circular discs rather than blades represent the simplest and sturdiest form of driving members and are less inclined to create windage problems. With such discs, the sides of the slot-like yarn guides preferably project beyond the circular parts of the peripheries of the discs, with the bottom of each slot preferably lying further from the common axis of the discs than do the circular peripheries of the discs. This latter feature ensures that when the yarn is located at the bottom of a slot-like guide during its movement across the traverse, its frictional contact with the circular part of the periphery of the other disc moving in the opposite direction is reduced to a predetermined level, or it is kept clear of the periphery altogether. With such projecting yarn guides, the compensating cams and lifting ramps may be constituted by smooth curves extending from the circular parts of the periphery of each disc up to the radially outermost part of the respective yarn guide.

The fact that, when using concentric discs, the yarn guides on the respective discs do not diverge at the end of the traverse makes the inclusion of one or more additional control surfaces on each deflector arrangement desirable, more particularly at higher speeds of operation. As already described, the compensating cams and lifting ramps on the discs themselves assist respectively in avoiding loss of tension in the yarn at the instant of transfer and in lifting the yarn from a yarn guide from which it is to be transferred. In order to assist the movement of the yarn into the yarn guide to which it is being transferred, the deflector arrangement at the end of the field of traverse at which the yarn is transferred from an outer to an inner guide preferably also includes a second control surface located in the gap for depressing the yarn towards the guides after it engages the first control surface in the gap and also a surface located adjacent the outer face of the outer driving member for deflecting the yarn in a direction away from the guides. The precise stage in the transfer operation at which each control surface acts depends largely on its circumferential location and the effect on the length of yarn extending between the two discs is that it first lightly brushes the second control surface in the gap without appreciable depression towards the guides and immediately thereafter engages the first control surface in the gap which then deflects it in the opposite direction. This action continues during the instant of reversal and as the yarn moves back again it loses contact with the first control surface and then immediately engages the second control surface for a second time which then produces a positive deflection towards the guides. It is found that this sequence of forces exerted on the yarn in conjunction with the forces exerted by the other components referred to is desirable in order to obtain effective transfer.

Yet another control surface may also be included at the same end of the field of traverse, i.e. that at which the yarn is transferred from an outer to an inner guide, this further surface being located adjacent the inner side of the inner driving member so as to depress the yarn in a direction towards the guide. The inclusion of such a further control surface brings the optimum number of such surfaces at this end of the traverse to a total of four, that is to say two surfaces located in the gap acting in the sequence already described to deflect the yarn away from the guides and to depress it towards them, a surface located adjacent the outer face of the outer driving member to deflect the yarn in a direction away from the guides and finally the surface located adjacent the inner side of the inner driving member for depressing the yarn in a direction towards the guides.

At the other end of the traverse, the transfer action is relatively simpler and in addition to the control surface located in the gap as already described, only a single further surface is preferred, this being located adjacent the inner side of the inner driving member for deflecting the yarn in a direction away from the guides.

When using eccentrically mounted driving members, the fact that the paths of the yarn guides diverge at the ends of the fields of the traverse, as already mentioned, simplifies the transfer action so that a simplified deflector arrangement may be used at each end of the field of traverse. The problem of the instantaneous loss of tension in the yarn applies in the same way as to concentric driving members and in addition to the control surface in the gap at each end of the traverse as already described, the peripheries of the two driving members are preferably shaped so that each yarn guide is followed in the direction of motion by a cam-like compensating surface. As described in relation to the concentric driving members, this temporarily increases the length of the yarn path so as at least partially to counteract any loss of tension.

Again it is found that discs are preferable to blades and these may conveniently be of generally oval shape with a yarn guide at each end of the major axis. For design purposes the driving members may be made as small as reasonably practicable, consistent with the requirement to traverse the yarn along a predetermined yarn path which may, for example, be a substantially constant velocity curve across the required width of field. The smaller each driving member, the more the path of a yarn guide would depart from such a path and to overcome this difficulty, each slot-like yarn guide may be made sufficiently deep to allow the yarn itself to follow the predetermined path across the field of traverse despite the fact that the bottom of the guide itself does not do so. In other words, at the centre of the field of traverse, the yarn will be located towards the bottom of the slot, but as the bottom of the slot moves away from the required path, so the yarn will move away from the bottom in order to follow the required path, reaching a point close to the mouth of the slot at the transfer point which, of course, facilitates transfer. The profiles of the discs may be shaped to control the position of the yarn along the slot by reason of its engagement during the traversing movement with the periphery of the disc which is not driving it at that time.

As already mentioned, the periphery of each driving member needs to be shaped to provide a cam-like compensating surface following each yarn guide, but no equivalent of the lifting ramps referred to in conjunction with the concentric discs, is required since the eccentricity of the driving members means that they are following different paths at the point of transfer and the driving member to which the yarn is to be transferred has a component of motion at this point which serves to lift the yarn from the yarn guide of the other member. Accordingly, the periphery of each driving member in the vicinity of each yarn guide may be such that the leading edge of each yarn guide in the direction of motion is closer to the axis of roation than the trailing edge. In other words, the trailing edge of each slot-like guide projects further than the leading edge. The shorter leading edge facilitates entry of the yarn at transfer while the projecting trailing edge may have the dual function of maintaining the yarn under the control of the guide which it is leaving until it has entered the oppositely moving guide and of constituting the beginning of the compensating surface which comes into action when the transfer of the yarn is complete.

Constructions of yarn winder in accordance with the invention will now be described in more detail, by way of example, with reference to the accompanying drawings, in which:

FIG. 5 is a diagrammatic perspective view of an alternative construction of winder including a traversing mechanism having eccentric oval discs;

FIG. 6 is a fragmentary perspective view of the winder of FIG. 5 seen from a different angle; and FIG. 7 is a front elevation illustrating the configuration and relative arrangement of the oval discs.

Figure 1:
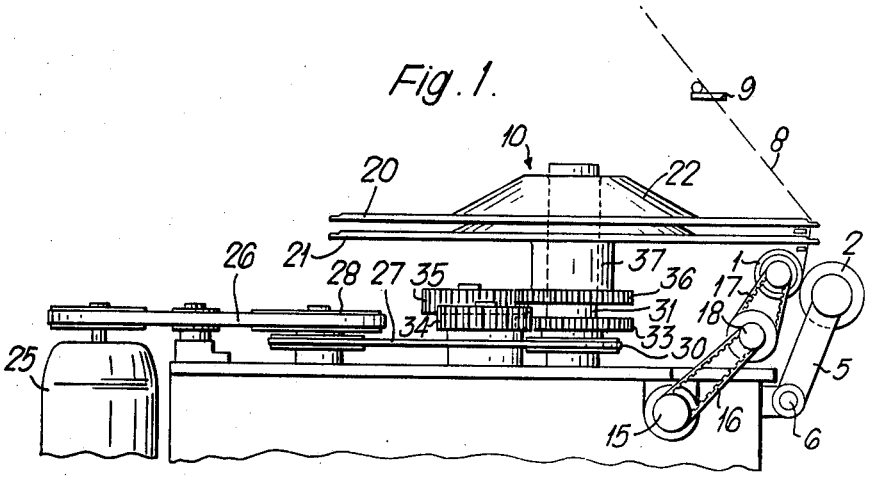
FIG. 1 is a side elevation of a winder including a traversing mechanism having a pair of vertically spaced concentric circular discs.
Figure 2:
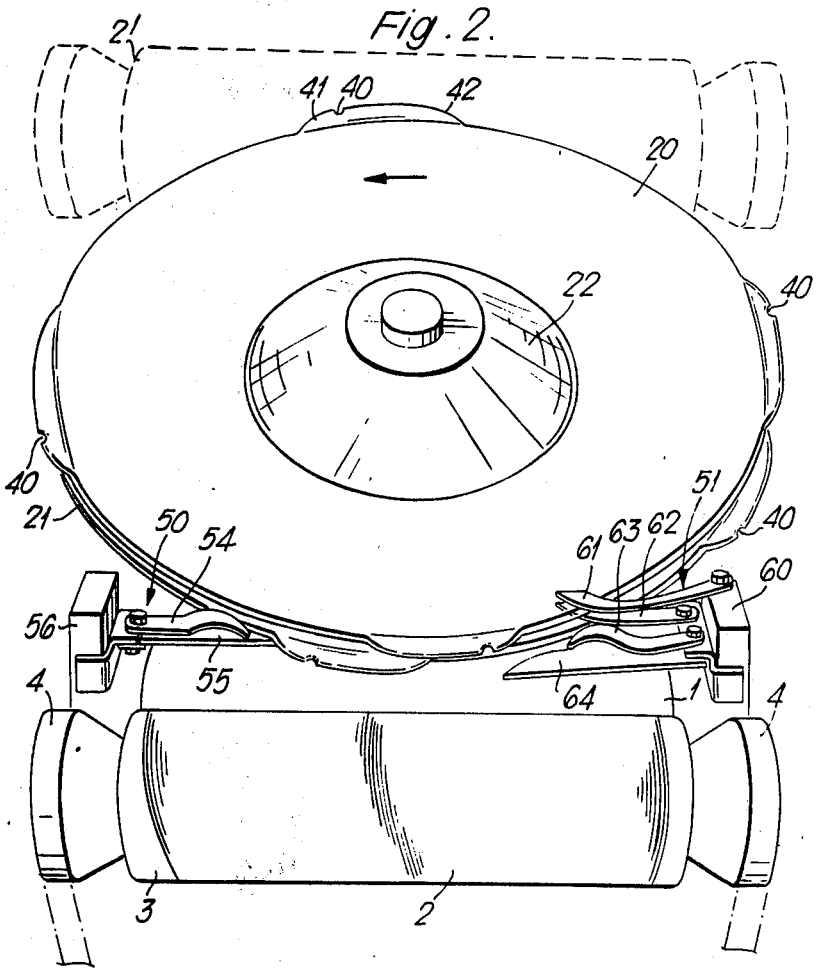
FIG. 2 is a perspective view of the winder of FIG. 1 as seen from the right and above.

Turning first to FIGS. 1 and 2, the winder illustrated comprises a package support roller constituted by a driving roller 1 which is shown in engagement with a package 2 being wound on a support 3 held between centres 4 supported by arms 5 pivoted at 6. The package 2 is biased into engagement with the driving roller 1 by a pneumatic loading arrangement (not shown). Yarn 8 passes downwardly through a guide 9 and is traversed along the length of the package 2 by a traversing mechanism indicated generally as 10, from where it passes to the nip between the driving roller 1 and the package 2. The driving roller 1 is driven from an electric motor 15 by way of toothed belts 16 and 17 through a double pulley assembly 18.

The traversing mechanism 10 comprises a pair of concentric circular discs 20 and 21 which turn about a vertical axis and which are strengthened by doming at 22. Both discs are driven from an electric motor 25 by way of toothed belts 26 and 27 through a double pulley assembly 28. The belt 27 drives a pulley 30 fixed to the shaft 31 of the disc 20. Using the terminology referred to previously, the disc 20 will be referred to as the outer disc and the disc 21 as the inner disc. A gear wheel 33 on the shaft 31 transmits drive through gear wheels 34 and 35 to a gear wheel 36 on a shaft 37 for the inner disc 21, the shaft 37 surrounding the shaft 31 and by way of the illustrated arrangement of gear wheels causing the disc 21 to turn in the opposite direction from the disc 20.

As better seen in FIG. 2, each of the discs 20 and 21 carries four slot-like yarn guides 40, each formed in a portion projecting from the circular periphery of the disc and the surface of which forms a lifting ramp 41 leading the guide 40 in the direction of rotation and a compensating cam 42 following the yarn guide 40 in the direction of rotation, the purpose of these components being described in more detail later. As seen in FIG. 2, the disc 20 rotates in an anti-clockwise direction and the disc 21 in a clockwise direction. As shown in FIG. 2, the traversing mechanism 10 serves only a single winding station represented by the package 2, but the mechanism is capable of simultaneously serving a second, diametrically opposite winding station indicated by the dotted rectangle 2' and could also serve third and fourth winding stations in the remaining two quadrants.

Referring to the winding station illustrated in FIG. 2, yarn guides 40 on the outer disc 20 traverse the yarn 8 from left to right along the length of the package 2 and, after transfer to a yarn guide 40 on the disc 21 at the right hand end of the field of traverse, the yarn 8 is traversed back again to the left hand end where it is again transferred back to a yarn guide 40 on the disc 20. For ease of reference, the transfer point at the left hand end of the field of traverse where the yarn is transferred from the inner disc 21 to the outer disc 20, is identified as 50, while the transfer point at the opposite end of the field of traverse is indicated as 51. A deflector arrangement is provided at each of the two transfer points to assist the transfer of the yarn from one yarn guide to the other. At the transfer point 50 the deflector arrangement comprises separate deflector members 54 and 55 located respectively in the gap defined between the discs 20 and 21 and their associated yarn guides and on the inner (or lower) side of the inner disc 21, these deflectors being supported by a common bracket 56. At the transfer point 51 there are four separate deflector members defining respective control surfaces for the yarn 8 and supported by a common bracket 60. Of these deflectors, a first 61 is located outside the outer disc 20, two further deflectors 62 and 63 are located in the gap between the discs and their associated yarn guides and a fourth 64 is located inside the inner disc 21. The functions of the two deflector arrangements and of the co-operating lifting ramps 41 and compensating cams 42 will now be described with reference to FIGS. 3 and 4.

Figure 3A:
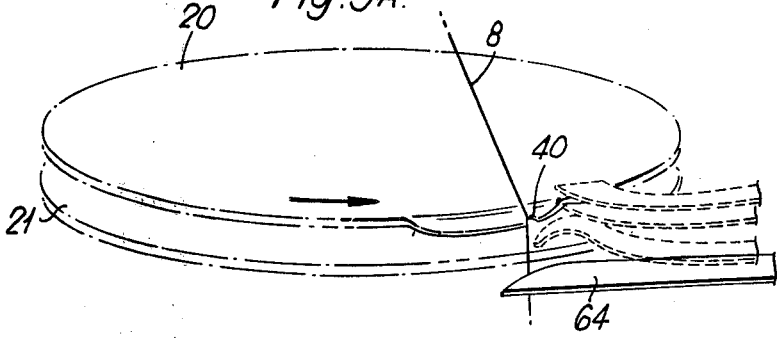
FIGS. 3A to 3D are diagrammatic views illustrating successive stages in the operation at the right hand end of the field of traverse as seen in FIG. 2.
Figure 3B:
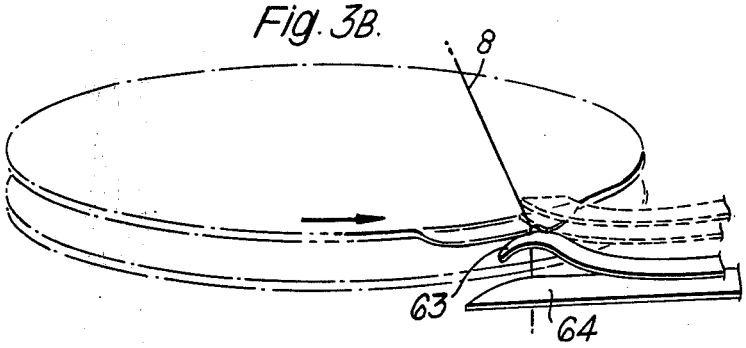
Figure 3C:
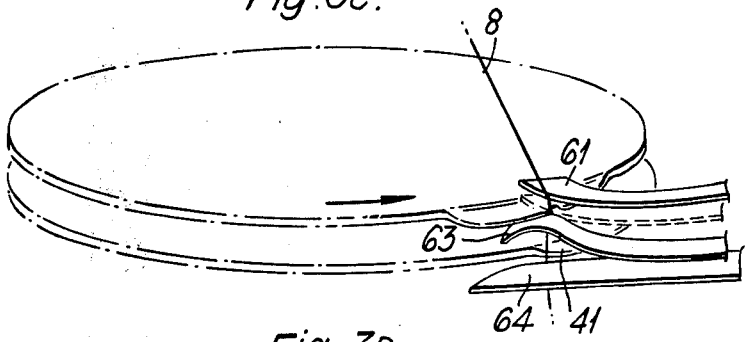
Figure 3D:
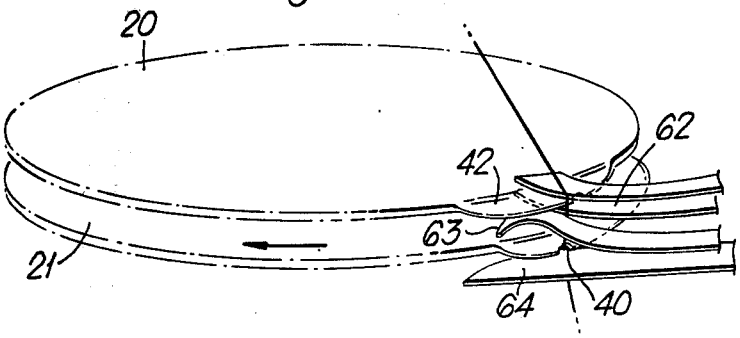

FIGS. 3A to 3D illustrate successive stages in the transfer operation at the point 51 and the convention is used to show each deflector which is operative at any instant in full lines and any deflector which has still to come into operation in dotted lines. The discs 20 and 21 are also shown in dotted lines and only the specific yarn guides 40 which take part in the transfer operation are illustrated. In FIG. 3A the yarn 8 is shown as being moved to the right by a yarn guide 40 on the disc 20. At this stage, only the deflector 64 has become effective to press the yarn towards the yarn guide. As a result of further movement to the right of the yarn guide 40, the yarn is brought into light brushing contact with the deflector 63, as shown in FIG. 3B, but without appreciable depression toward the guides (as previously pointed out). At the next stage illustrated in FIG. 3C the lifting ramp 41 on the disc 21 has started to come into action and at about the same time, the deflector 61 starts to act in the same direction, causing the yarn 8 to move out of the guide 40, this being permitted by the curvature of the deflector 63. By the time the position of FIG. 3D is reached, the yarn 8 has engaged the last of the deflectors 62 and since, by this time it has moved away from the deflector 63, the deflector 62 is able to assist the deflector 61 and the lifting ramp 41 to complete the removal of the yarn 8 from the guide 40 on the disc 20, the continuing effect of the deflector 64 being to depress the yarn immediately into the guide 40 on the disc 21.

The yarn is therefore immediately driven back to the left and then re-engages the deflector 63 which assists the deflector 64 in holding the yarn in the yarn guide 40 on the disc 21. During the first part of its movement to the left, the yarn rides over the compensating cam 42 on the disc 20 which lengthens the yarn path sufficiently to compensate for the momentary loss in tension as the yarn is transferred from one guide to the other. Thereafter, the yarn 8 continues to move to the left, moving down the slope of the cam 42 and then moving freely just out of contact with the circular part of the periphery of the disc 20 owing to the fact that the bottom of the guide 40 is slightly further from the axis of the two discs than the circular part of the periphery.

Figure 4A:
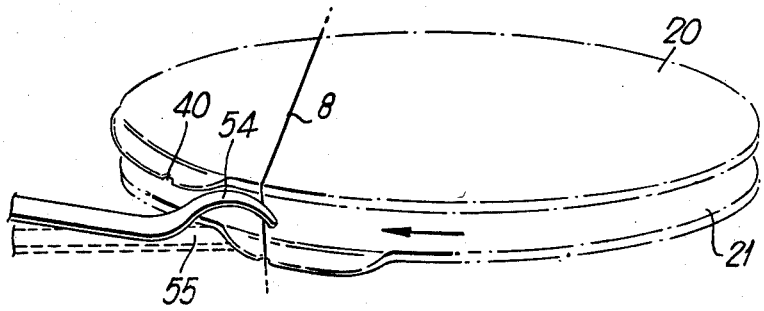
FIGS. 4A to 4D are similar diagrammatic views illustrating stages in the operation at the left hand end of the field of traverse.
Figure 4B:
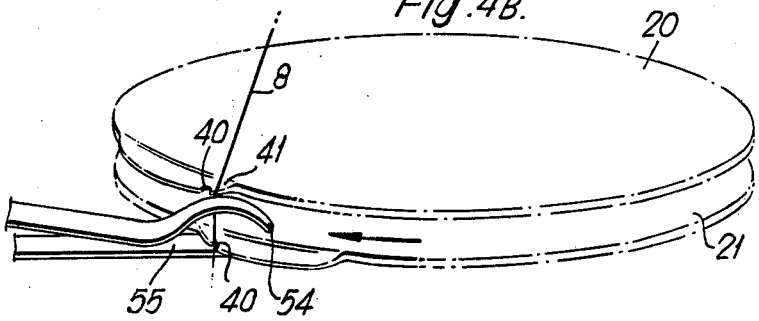
Figure 4C:
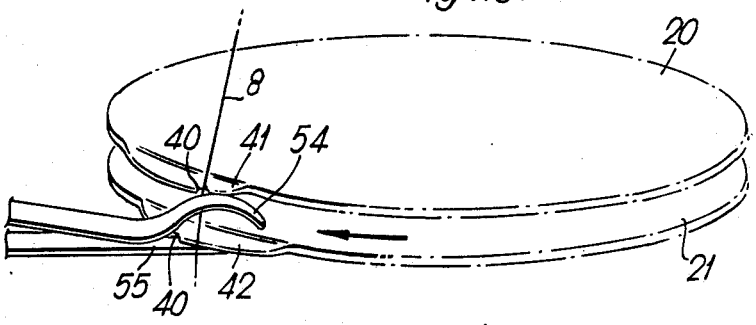
Figure 4D:
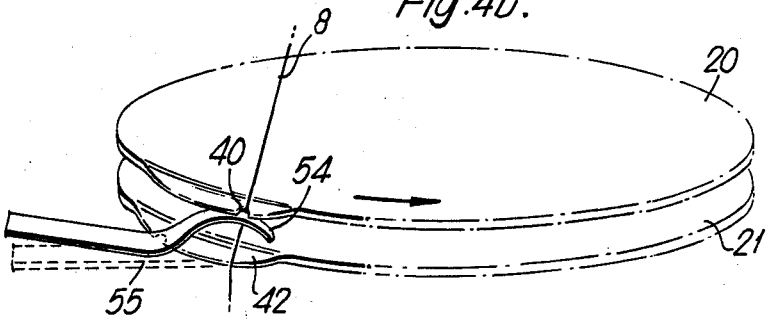

The yarn 8 is then moved freely across the field of traverse until it approaches the transfer point 50 where the sequence of stages is illustrated in FIGS. 4A to 4D. The same convention is used again in that in FIG. 4A the deflector 54 which is first engaged by the yarn is shown in full lines while the deflector 55 which is only engaged subsequently is shown in dotted lines. Engagement with the deflector 54 presses the yarn towards the circular part of the periphery of the disc 20, ready for entry into the approaching guide 40 on that disc. By the time the position of FIG. 4B has been reached, the lifting ramp 41 on the disc 20 has started to lift the yarn in readiness for its entry into the guide 40 on the disc 20 and at the same time the deflector 55 has started to come into action to lift the yarn out of the guide 40 on the disc 21. The deflector 54 continues to bear against the yarn to have a stabilising effect. In the position of FIG. 4C the yarn 8 has reached the end of the ramp 41 and dropped into the guide 40 on the disc 20 and the deflector 55 has completed the lifting of the yarn from the guide 40 on the disc 21. As can be seen from this Figure, the yarn has been lifted on to the end of the compensating cam 42 on the disc 21 ready to move to the right as illustrated in FIG. 4D. As shown in this Figure, the yarn 8 is moving to the right, having left contact with the deflector 55 and being about to leave the stabilising influence of the deflector 54. The compensating cam 42 is just completing its function of lengthening the yarn path to compensate for the momentary loss of tension at the instant of transfer. Thereafter, the yarn 8 continues to move to the right under the control of the disc 20, being held just out of contact with the circular part of the periphery of the disc 21 by the guide 40 on the disc 20. The cycle is then repeated.

It will be appreciated that since there are four equally spaced yarn guides around the periphery of each disc and since these are moving together at equal speeds, the length of the field of traverse is approximately equal to one eighth of the circumference of the discs. As previously mentioned, the single winding station illustrated can be duplicated on the opposite side of the discs and, if desired, two further winding stations may be provided in the remaining quadrants. Since each successive field of traverse occupies only approximately one eighth of the total circumference, ample space is provided for the separate winding stations without the danger of interference between adjacent transfer points. In other words, considering any one yarn guide, this will carry a yarn over approximately one eighth of the circumference for the first winding station and will then be free for the next one eighth of a revolution before taking over control of the yarn at the next winding station.

Although there is no danger of interference between winding stations, however, this possibility does require the use of relatively large discs which are also beneficial from the point of view of package formation with some materials, e.g. textured filaments. For example, when winding a typical package of length 25 centimeters the circumference of the discs will be approximately eight times this length, i.e. in the region of 200 centimeters with a gap between the discs of 6.3 millimeters. With a winder of the type illustrated in which the package is driven by the driving roller 1, this driving roller can be driven at a constant speed giving a constant surface speed to the package 2 and hence requiring a constant traversing speed from the discs 20 and 21.

Consequently, even though the packages at the different winding stations will normally be at different stages of winding, this in no way affects the operation of the discs 20 and 21 which can continue to rotate at constant speed. A yarn winder as just described is suitable for operation at very high yarn speeds, e.g. 5000 meters/minute which is appropriate e.g. for the winding of textured filaments directly from a draw/texturising head.

Despite the possibility of the traversing mechanism serving more than one winding station as just described, it is frequently more convenient to have only a single winding station as, in fact, illustrated in FIG. 1. This leads to a possible further variation in the mode of operation. It is found in practice that some yarns are more difficult to wind than others and that there is a risk that the last turn or two at the ends of the package may fall over the end of the package. With other forms of traversing mechanism, it is common to apply a progressive mechanical reduction to the traverse so that each successive layer stops short just before that beneath it, thus ensuring that the last one or two turns are firmly supported and cannot fall over the end of the package.

Such known traverse reducing mechanisms cannot be adopted in conjunction with a winder in accordance with the present invention since, as made clear above, the length of traverse is directly related to the dimensions of the discs. A corresponding result may be obtained, however, by progressively increasing the speed of the discs throughout the winding operation and thus increasing the helix angle as the yarn is wound onto the package. This in its turn reduces the effective length of traverse across the package. The effect can best be appreciated by reference to a numerical example. If the diameter of the discs is 70 centimeters and the mechanism is adjusted to provide a package of length 27 centimeters, the length of the package may be reduced from this nominal value at the start of winding to 24.5 centimeters at the end of winding on a 25 centimeter package, by increasing the speed of traverse as just described.

If the winder is of the precision type the package is wound directly upon a driven spindle and the speed of this spindle therefore needs to be reduced progressively to give a constant surface speed for the package and hence a constant delivery speed for the yarn. With this type of winder, the package support roller may take the form of a speed control roller which is driven by the package and which, in its turn, operates to regulate the speed of the drive. Corresponding speed regulation is therefore required for the traversing mechanism and this renders it impossible to have more than one winding station served by the same traversing mechanism. Accordingly, for some materials, for example jute, which are not as easily damaged as others such as textured filaments there is no benefit in discs of the large size referred to above and, in practice, it is convenient to make the discs as small as reasonably practicable. Under these circumstances, it is then preferable to use an eccentric arrangement of discs as illustrated in FIGS. 5 to 7. The winder shown diagrammatically in these Figures is intended for the winding of yarn from a free-standing supply source where the requirement for high speed is not linked directly to the characteristics of another machine such as an extruder, but where high speeds of operation are nevertheless desirable in the interests of high production.

Referring to FIG. 5, the drawing is only diagrammatic in the sense that no details of the various drives or controls are included. In this modified construction, the two driving members are in the form of discs of generally oval shape as best seen in FIG. 7, with the major axis rather less than one and a half times as long as the minor axis. These discs are shown in FIG. 5 as 120 and 121 and have slot-like yarn guides 140 at each end of the major axis. The discs each turn about a horizontal axis in the directions indicated by the arrows, i.e. the disc 120 turning in a clockwise direction and the disc 121 turning in an anti-clockwise direction. As can be seen from the drawings, the trailing edge of each yarn guide 140, in the direction of motion, projects further from the axis than the leading edge, thus facilitating entry of the yarn into each guide and providing a compensating cam 142 to follow each guide in the direction of motion.

The winder is of the precision type with the package 102 being wound on a driven spindle 103, mounted on a pivoted arm (not illustrated) for movement away from the discs as the package diameter increases. A package support roller 101 which defines a nip with the package 102 to which the yarn 108 passes, is driven by the package 102 and operates to reduce the speed of the spindle 103 as the package 102 builds up, so as to give a constant surface speed to the package and also to reduce the speed of the discs. The roller 101 is mounted between a pair of arms, part of one of which is seen at 105. The yarn 108 passes to the traversing mechanism by way of a guide 109 and to avoid the possibility of the yarn being plucked by the edge of a guide as it leaves it, the angle of approach of the yarn and hence the height of the guide 109 is important. In practice, the height of the guide 109 above the level of the axes of the two discs must be greater than the length of the major axis of each disc.

FIG. 5 illustrates the position of the discs 120 and 121 a little after the yarn has been transferred at the left hand end of the field of traverse, shown as 150. At this point the deflector arrangement comprises only a single deflector member 154 located in the gap between the two discs. As the yarn 108 is traversed to the left towards the point 150, by means of a yarn guide 140, on the disc 121, its contact with the periphery of the disc 120 progressively lifts the yarn in the guide 140. As it approaches the point 150, the deflector 154 operates to depress the yarn between the two discs to ensure that it enters the slot 140 of the disc 120 while still under the control of the trailing edge of the guide 140 of the disc 121, this action also holding the yarn in contact with the compensating cam 142 on the disc 121 so as to compensate for any momentary loss of tension at the instant of transfer.

At the start of its traversing movement to the right, as seen in FIG. 5, the yarn is spaced away from the bottom of the slot forming the guide 140. Since both discs are relatively small, the path of the bottom of the guide 140 across the field of traverse is somewhat curved, but owing to the depth of the slot and the fact that the yarn can move towards the bottom of the slot as the centre of the traverse is reached, the yarn is able to follow the chosen path.

The right hand transfer point is indicated as 151 and here the yarn is transferred from the outer disc 120 to the inner disc 121. The deflector arrangement at the point 151 comprises two separate deflector members carried by a common bracket 160. One deflector 162 is located in the gap between the two discs and a second deflector 164 is located outside the outer disc 120. Since the transfer at this end of the traverse is in the opposite direction from that at the point 150, the effect of the engagement of the yarn with the surface of the disc 121 is not quite sufficient to lift the yarn out of the guide 140 on the disc 120 and the deflector 162 provides the additional lift to the yarn to remove it from this guide after it has entered the guide 140 on the disc 121. The outer deflector 164 acts as a retainer to press the yarn towards the discs during this operation and to hold the yarn against the compensating cam 142 on the disc 120 immediately after the completion of the transfer so as to compensate for any momentary loss of tension.

What I claim is:

1. A yarn winder including a package support roller and traversing mechanism comprising slot-like guides on closely spaced driving members connected to a drive so as to move in opposite directions across a field of traverse, and a deflector arrangement at each end of the field of traverse for assisting the transfer of the yarn from a guide on one driving member at one end of the field and then back to a guide on the first driving member at the other end of the field, each of the deflector arrangements including a control surface which is engaged by the yarn between the two yarn guides and is located in a gap defined on each side by a driving member and its associated yarn guide, the control surface at one end of the field of traverse being arranged to deflect the yarn in a direction away from the guides when the yarn is being transferred from an outer to an inner guide, while at the opposite end of the field the control surface acts to depress the yarn toward the guides when the yarn is being transferred from an inner to an outer guide, the driving members being mounted for rotation in opposite directions and their peripheries being so shaped that each yarn guide is followed in the direction of motion by a cam-like compensating surface for temporarily increasing the yarn path by an amount sufficient to take up the slack which would otherwise be formed immediately after the yarn has been removed from one slot-like guide during transfer of the yarn from one slot-like guide to another.

2. A yarn winder including a package support roller and traversing mechanism comprising slot-like guides on closely spaced driving members connected to a drive so as to move in opposite directions across a field of traverse, the driving members being concentrically mounted for rotation in opposite directions, and a deflector arrangement at each end of the field of traverse for assisting the transfer of the yarn from a guide one driving member at one end of the field and then back to a guide on the first driving member at the other end of the field, each of the deflector arrangements including a control surface which is engaged by the yarn between the two yarn guides and is located in a gap defined on each side by a driving member and its associated yarn guide, the control surface at one end of the field of traverse being arranged to deflect the yarn in a direction away from the guides when the yarn is being transferred from an outer to an inner guide, while at the opposite end of the field the control surface acts to depress the yarn toward the guides when the yarn is being transferred from an inner to an outer guide, the deflector arrangement at the end of the field of traverse at which the yarn is transferred from an outer to an inner guide also including a second control surface located in the gap for depressing the yarn toward the guides after it engages the first control surface in the gap and a surface located adjacent the outer face of the outer driving member for deflecting the yarn in a direction away from the guides, the peripheries of the driving members being so shaped that each yarn guide is followed in the direction of motion by a cam-like compensating surface for temporarily increasing the yarn path by an amount sufficient to at least substantially take up the slack which would otherwise be formed immediately after the yarn has been removed from one slot-like guide during transfer of the yarn from one slot-like guide to another, and the periphery of at least the inner driving member being so shaped that each yarn guide thereon is preceded in the direction of motion by a ramp-like lifting surface for lifting the yarn in a direction which tends to remove it from a yarn guide of the other driving member.

3. A yarn winder including a package support roller and traversing mechanism comprising slot-like guides on closely spaced driving members connected to a drive so as to move in opposite directions across a field of traverse, the driving members being eccentrically mounted relative to one another on spaced axes, and a deflector arrangement at each end of the field of traverse for assisting the transfer of the yarn from a guide on one driving member at one end of the field and then back to a guide on the first driving member at the other end of the field, each of the deflector arrangements including a control surface which is engaged by the yarn between the two yarn guides and is located in a gap defined on each side by a driving member and its associated yarn guide, the control surface at one end of the field of traverse being arranged to deflect the yarn in a direction away from the guides when the yarn is being transferred from an outer to an inner guide, while at the opposite end of the field the control surface acts to depress the yarn toward the guides when the yarn is being transferred from an inner to an outer guide, the deflector arrangement at the end of the field of traverse at which the yarn is transferred from an outer to an inner guide also including a surface located outside the driving member for depressing the yarn in a direction toward the guides, the peripheries of the driving members being so shaped that each yarn guide is followed in the direction of motion by a cam-like compensating surface for temporarily increasing the yarn path by an amount sufficient to at least substantially take up the slack which would otherwise be formed immediately after the yarn has been removed from one slot-like guide during transfer of the yarn from one slot-like guide to another.

4. A yarn winder according to claim 2 in which the driving members are in the form of concentric circular discs with the sides of the yarn guides projecting beyond the circular parts of the peripheries of the discs.

5. A yarn winder according to claim 4 in which the bottom of each slot-like guide lies further from the common axis of the discs than do the circular peripheries of the discs.

6. A yarn winder according to claim 2 in which the deflector arrangement at the end of the field of traverse at which the yarn is transferred from an outer to an inner guide in addition includes a surface located adjacent the inner side of the inner driving member for depressing the yarn in a direction towards the guides.

7. A yarn winder according to claim 2 or claim 6 in which the deflector arrangement at the end of the field of traverse at which the yarn is transferred from an inner to an outer guide also includes a surface located adjacent the inner side of the inner driving member for deflecting the yarn in a direction away from the guides.

8. A yarn winder according to claim 1 in which the driving members are eccentrically mounted relative to one another on spaced axes.

9. A yarn winder according to claim 8 in which the driving members are discs of generally oval shape with a yarn guide at each end of the major axis.

10. A yarn winder according to claim 9 in which the periphery of each disc is so shaped as to control the radial position of the yarn in a yarn guide of the other disc over at least part of the traverse.

11. A yarn winder according to claim 8, or claim 9, or claim 10 in which the leading edge of each yarn guide in the direction of motion is closer to the axis of rotation than the trailing edge.

12. A yarn winder according to claim 11 and including a yarn guide prior to the driving members which is situated at a perpendicular distance from the axes of rotation which is greater than the greatest radial dimension of either driving member.

13. In a yarn winder including driving means for a package to be wound and a package support roller, a traversing mechanism comprising closely spaced concentric inner and outer driving discs, means driving said discs in opposite directions of rotation, said discs being formed with slot-like yarn guides between which yarn being wound can be transferred, each said disc having its periphery so shaped that each said yarn guide is followed in the direction of rotation by a cam-like compensating surface for temporarily increasing the yarn path by an amount sufficient to take up at least partially the slack which would otherwise be formed immediately after the yarn has been removed from one slot-like guide during transfer of the yarn from one slot-like guide to another, and is preceded in the direction of rotation by a ramp-like lifting surface for moving the yarn in a direction which tends to remove it from a yarn guide of the other driving disc, a pair of spaced deflector arrangements for assisting transfer of yarn from a guide on one said disc to a guide on the other said disc, said deflector arrangements defining between them a field of traverse, said yarn being carried across said field of traverse by said yarn guides on said driving discs, said deflector arrangement at the end of said field of traverse at which said yarn is transferred from a guide on said outer disc to a guide on said inner disc including a first control surface for deflecting said yarn away from said guides, said control surface being located in a gap defined on each side by a driving member and its associated yarn guide, said deflector arrangement also including a second control surface located in said gap for depressing said yarn towards said guides after said yarn has engaged said first control surface in said gap and a third control surface located adjacent the outer face of said outer driving disc for deflecting said yarn in a direction away from said guides, said deflector arrangement at the end of said field of traverse at which said yarn is transferred from a guide on said inner disc to a guide on said outer disc including a fourth control surface located in said gap to depress said yarn towards said guides and a fifth control surface located adjacent the inner side of said inner driving disc for deflecting said yarn in a direction away from said guides.

14. A yarn winder as claimed in claim 13 wherein said deflector arrangement at the end of said field of traverse at which said yarn is transferred from a guide on said outer disc to a guide on said inner disc additionally includes a sixth control surface located adjacent the inner side of said inner driving disc for depressing said yarn in a direction towards said guides.

15. In a yarn winder including driving means for a package to be wound and a package support roller, a traversing mechanism comprising closely spaced inner and outer driving discs, said discs being of generally oval shape, said discs being eccentrically mounted relative to one another on spaced axes, means driving said discs in opposite directions of rotation, each said disc being formed with a slot-like yarn guide at each end of its major dimension, each said disc being further shaped whereby each yarn guide is followed in the direction of motion of said yarn guide by a cam-like compensating surface for temporarily increas- the yarn path by an amount sufficient to take up at least partially the slack which would otherwise be formed immediately after the yarn has been removed from one slot-like guide during transfer of the yarn from one slot-like guide to another, a pair of spaced deflector arrangements for assisting transfer of yarn from a guide on one said disc to a guide on the other said disc, said deflector arrangements defining between them a field of traverse, said yarn being carried across said field of traverse by said yarn guides on said driving discs, said deflector arrangement at the end of said field of traverse at which said yarn is transferred from a guide on said outer disc to a guide on said inner disc including a first control surface for deflecting said yarn away from said guides, said control surface being located in a gap defined on each side by a driving member and its associated yarn guide, said deflector arrangement also including a second control surface located outside said outer driving disc for depressing said yarn in a direction towards said guides, said deflector arrangement at the end of said field of traverse at which said yarn is transferred from a guide on said inner disc to a guide on said outer disc including a third control surface located in said gap to depress said yarn towards said guides.

* * * * *